US008591439B1

(12) United States Patent
Flood et al.

(10) Patent No.: US 8,591,439 B1
(45) Date of Patent: Nov. 26, 2013

(54) EXTENDED TERM PATIENT RESUSCITATION/VENTILATION SYSTEM

(75) Inventors: Michael G. Flood, Pensacola, FL (US); Richard J. Kotalik, Rushville, NY (US); Donald Rulifson, St. George, UT (US); Robert M. Hamilton, Menifee, CA (US)

(73) Assignee: AutoCPR, Pensacola, FL (US)

( * ) Notice: Subject to any disclaimer, the term of this patent is extended or adjusted under 35 U.S.C. 154(b) by 0 days.

(21) Appl. No.: 13/573,012

(22) Filed: Aug. 13, 2012

(51) Int. Cl.
*A61H 31/00* (2006.01)
*A62B 9/02* (2006.01)

(52) U.S. Cl.
USPC ..... 601/41; 601/148; 601/150; 601/151; 137/596; 128/205.24

(58) Field of Classification Search
USPC ..... 601/41–44, 106, 148–152, 601/DIG. 6–DIG. 10; 602/13; 128/201.28, 128/203.11, 205.24, 206.15, 207.12, 128/DIG. 20; 137/596.18, 596
See application file for complete search history.

(56) References Cited

U.S. PATENT DOCUMENTS

| | | | | |
|---|---|---|---|---|
| 3,461,858 | A | 8/1969 | Michaelson | |
| 3,880,149 | A | 4/1975 | Kawaguchi | |
| 3,885,554 | A * | 5/1975 | Rockwell, Jr. | 601/150 |
| 3,889,668 | A | 6/1975 | Ochs et al. | |
| 3,896,794 | A | 7/1975 | McGrath | |
| 3,942,518 | A | 3/1976 | Tenteris et al. | |
| 4,297,999 | A | 11/1981 | Kitrell | |
| 4,349,015 | A * | 9/1982 | Alferness | 601/41 |
| 4,397,306 | A | 8/1983 | Weisfeldt et al. | |
| 4,407,588 | A | 10/1983 | Arichi et al. | |
| 4,424,806 | A * | 1/1984 | Newman et al. | 601/41 |
| 4,575,651 | A | 3/1986 | Hoelzer | |
| 4,638,837 | A * | 1/1987 | Buike et al. | 137/627.5 |
| 4,753,226 | A * | 6/1988 | Zheng et al. | 601/150 |
| 4,770,165 | A | 9/1988 | Hayek | |
| 4,775,801 | A | 10/1988 | Baum | |
| 4,930,498 | A | 6/1990 | Hayek | |
| 5,036,841 | A | 8/1991 | Hamilton | |
| 5,310,111 | A * | 5/1994 | Linck | 236/49.4 |
| 5,327,887 | A | 7/1994 | Nowakowski | |
| 5,370,603 | A | 12/1994 | Newman | |
| 5,490,820 | A | 2/1996 | Schock et al. | |
| 5,514,079 | A | 5/1996 | Dillon | |
| 5,725,485 | A | 3/1998 | Ribando et al. | |

(Continued)

FOREIGN PATENT DOCUMENTS

WO WO 2010/151278 12/2010

*Primary Examiner* — Justine Yu
*Assistant Examiner* — Christopher Miller
(74) *Attorney, Agent, or Firm* — Harold L. Jackson

(57) ABSTRACT

An extended term resuscitation system includes a plurality of inflatable cuffs adapted to extend around separate portions of the anatomy of a patient (i.e. the chest, abdomen and legs) for enhancing the circulation when inflated/deflated periodically. A primary low-pressure-high-volume air compressor is in fluid communication with each of the cuffs through individual air handlers. The air handlers are formed with an inflation and a deflation diaphragm valve which, under the control of an electronic timer and a pneumatic circuit, connect the respective cuff to the output of the compressor for inflation or to the atmosphere for deflation. A secondary air compressor provides air under suitable pressure to the pneumatic circuit for the control of the diaphragm valves. As an option the operator may change the cyclical rate and cuff pressure. A ventilator provides oxygen to the patient in selected volumes or on demand.

22 Claims, 11 Drawing Sheets

(56) References Cited

U.S. PATENT DOCUMENTS

| | | | | |
|---|---|---|---|---|
| 5,806,512 | A * | 9/1998 | Abramov et al. | 128/204.18 |
| 6,030,353 | A | 2/2000 | Van Brunt | |
| 6,095,139 | A | 8/2000 | Psaros | |
| 6,589,267 | B1 * | 7/2003 | Hui | 606/202 |
| 6,591,835 | B1 * | 7/2003 | Blanch | 128/204.25 |
| 6,676,614 | B1 * | 1/2004 | Hansen et al. | 601/41 |
| 7,074,177 | B2 * | 7/2006 | Pickett et al. | 600/17 |
| 7,258,676 | B2 * | 8/2007 | Calderon et al. | 602/13 |
| 2003/0233061 | A1 | 12/2003 | Hui | |
| 2005/0011518 | A1 * | 1/2005 | Biondo et al. | 128/204.18 |
| 2005/0126578 | A1 * | 6/2005 | Garrison et al. | 128/874 |
| 2010/0326442 | A1 * | 12/2010 | Hamilton et al. | 128/204.21 |

* cited by examiner

3-WAY VALVE

OFF

ON

AUTO

EXTENDED TERM PATIENT RESUSCITATION/VENTILATION SYSTEM

FIELD OF THE INVENTION

This invention relates to an apparatus or system for providing cardiac and/or pulmonary resuscitation and more particularly to such a system that is automated and capable of enhancing a patient's circulation and ventilation for an extended period.

BACKGROUND OF THE INVENTION

State of the art methods and apparatus for providing external cardiac resuscitation are discussed to some extent in U.S. Pat. No. 5,806,512 ("'512 patent"). The '512 patent teaches the use of inflatable cuffs surrounding a patient's chest, abdomen and legs which are periodically inflated and deflated to force blood from the extremities to and through the heart with the chest and abdomen functioning in an out-of-phase relationship. Ventilation via a patient mask is also disclosed in the patent.

More recently a portable resuscitation/ventilation system using inflatable chest, abdominal and leg cuffs and a ventilator coupled to self-contained cylinders of compressed gas is described in international publication WO 2010/151278 A1 ("'278 pub.") and disclosed on the web site AutoCPR.net. Solenoid operated valves, controlled by an electronic timer, connect the cuffs alternately to the compressed gas cylinders and to the ambient or atmosphere to inflate and deflate the cuffs in a timed sequence. For example, the chest and abdominal cuffs are operated in an out-of-phase sequence at a 30 cycles per minute rate, i.e., one second on (inflation) and one second off (deflation). The leg cuffs can be inflated and deflated at the same or a different rate. For example, the leg cuffs can be inflated continuously or inflated/deflated every fifth cycle of the chest cuff with the inflation period exceeding the deflation period. The portable gas supply is designed to provide adequate time to achieve the return of spontaneous circulation (ROSC) and patient transport to a hospital emergency department. A face mask and a tank of breathable gas provide ventilation for the patient. The resuscitator/ventilator of the '278 pub. is small enough to fit into a suitcase easily handled by a paramedic or other first responder. While it is believed to be cutting edge for its intended purpose, the use of compressed gas cylinders limits its operating time.

Recent clinical studies have demonstrated that the continued support of a patient's circulation (such as uninterrupted chest compression) after ROSC significantly improves the survival rate of patients after leaving the hospital. See, for example, the Journal of Emergency Medicine, 1008, Feb. 12, 2009 by M. Riscon, et al; the European Resuscitation Council Guideline for Resuscitation 2005 by A J Hadley, et al; Critical Care 2005, 9:287-290 by M H Weil and Shijie Sun; and Burst Stimulation Improves Hemodynamics during resuscitation etc. in Circulation: 2009, 2:57-62 by G. Walcott et al.

There is a need for a system/apparatus which will not only aid in achieving a patient's ROSC but in addition continue to support the patient's circulatory system over an adequate time period after ROSC to improve the out of hospital survival rates for patients suffering cardiac arrest or other serious heart problems.

SUMMARY OF THE INVENTION

A patient resuscitation system, in accordance with the present invention, includes a plurality of inflatable cuffs adapted to extend around separate portions of a patient's anatomy (e.g, chest, abdomen and legs) for increasing the patient's blood flow when periodically inflated/deflated (1) to achieve ROSC and subsequently (2) to continue the support of his/her circulatory system. A timer, such as the timer disclosed in the '278 pub., sets the inflation/deflation periods. Air for the inflation steps is provided by a primary low-pressure-high-volume-air-compressor connected to a volume chamber (i.e. to smooth out pressure fluctuations). A pneumatic circuit, including a pressurized gas source, such as a secondary compressor, provides a separate pneumatic control signal associated with each cuff bracketing each inflation period set by the timer. An air handler is individually connected between each cuff, the volume chamber and the atmosphere (or ambient) and responsive to the pneumatic control signals for inflating/deflating each cuff in accordance with the inflation/deflation periods set by the timer.

Each air handle preferably includes an inflation and a deflation diaphragm valve with the valves being located between the cuff, the volume chamber and the atmosphere, respectively. Preferably each diaphragm valve is normally open connecting the cuff to the volume chamber and to the atmosphere with each valve being arranged to close in response to the receipt of a control signal and open in the absence of a control signal. Accordingly, each cuff will be connected to the volume chamber for inflation purposes in the absence of a control signal being applied to the inflation diaphragm valve and in the presence of a control signal being applied to the deflation diaphragm valve closing off the cuff from the atmosphere and visa versa. Alternatively the diaphragm valves connecting the cuffs to the volume chamber can be closed independently of the operation of the timer.

In a preferred embodiment the inflation diaphragm valve, in the form of an air module, connects the associated cuff to the volume chamber when open and the deflation valve, in the form of an air relay, connects the associated cuff to the atmosphere when open.

Preferably there is a chest, abdominal, and two leg cuffs. The pneumatic circuit includes a control valve for each air handler. The control valves for the chest and abdominal cuffs have (1) an auto position (responsive to the timer) in which the control signals are directed to the inflation and deflation diaphragm valves alternately to inflate and deflate the chest and abdominal cuffs in an out-of-phase relationship and (2) an off position in which the pneumatic control signals are continuously (when present) applied to the inflation diaphragm valves to close the same. At the same time the deflation diaphragm valves are opened by the absence of the next control signal, resulting in a deflation mode for the cuffs in the off mode.

The control valve for the leg cuffs has an auto position in which the cuffs are alternately inflated and deflated in accordance with the dictates of the timer, an on position in which the cuffs are continuously inflated, and an off position in which the cuffs are continuously deflated.

Preferably the diaphragm valves are mounted in a common manifold block with the block providing fluid communication between each pair of (inflation and deflation) valves and the associated cuff.

A manually adjustable pressure/cycle rate valve may be coupled to the volume chamber and the timer for allowing the operator to select different cyclical rates (e.g. 30 or 20 cycles per minute) and different pressures (e.g. 150 or 100 mm Hg.) in the volume chamber. A ventilator, like the one disclosed in the '278 pub., may be included in the apparatus.

The face mask and cuffs may be disposable to comply with applicable health standards. The content of the '278 pub. (now U.S. Pat. No. 8,277,399) are incorporated in their entirety herein, by reference.

DESCRIPTION OF THE PREFERRED EMBODIMENT

Overview of the System Operating in an Exemplary Mode

Figure 1:
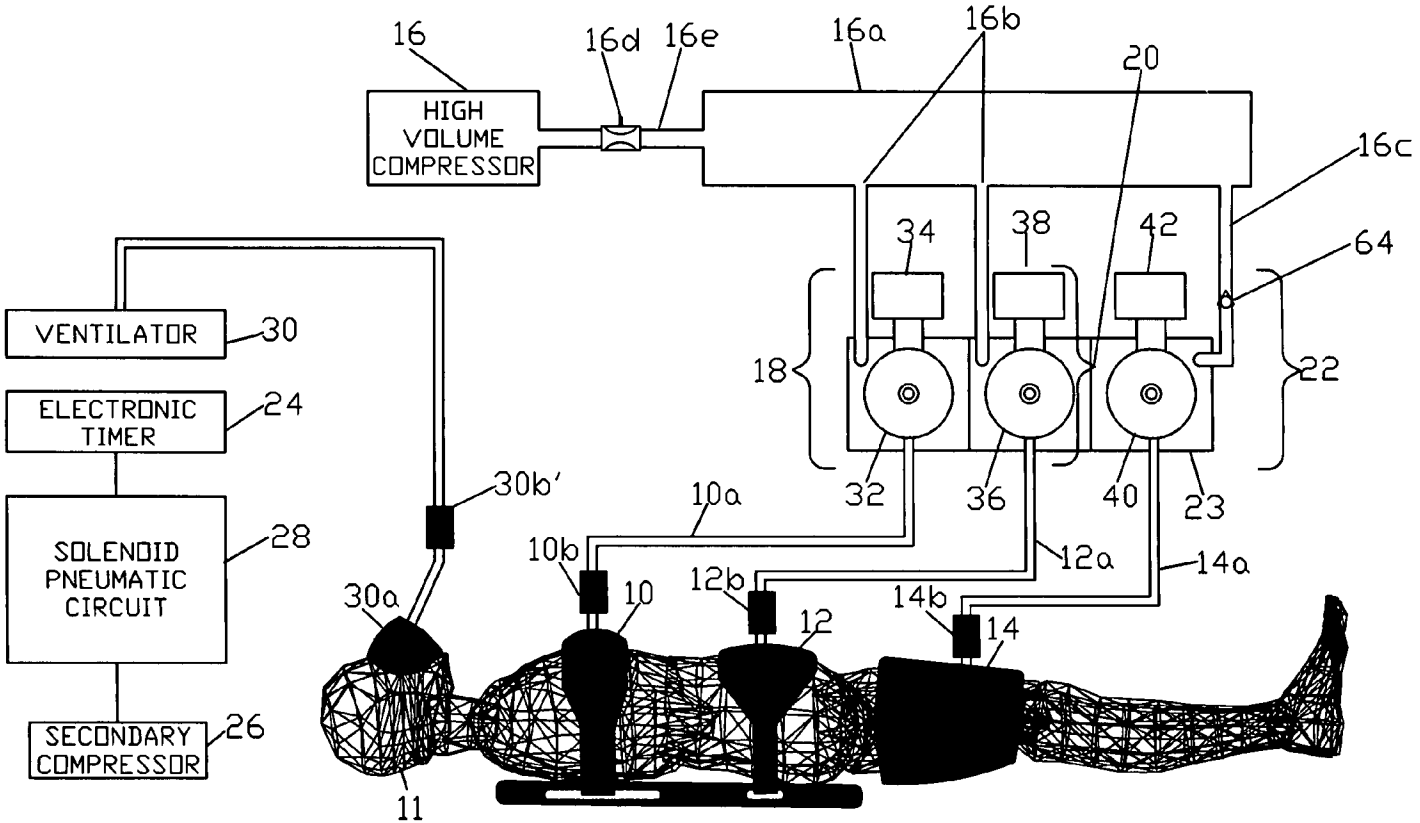
FIG. 1 is a schematic diagram of an apparatus/system in accordance with this invention, showing an individual air handler connecting each cuff (extending around a separate portion of a patient's anatomy) to the volume chamber and to the atmosphere. This figure also depicts a ventilator and a face mask.

Referring now to FIG. 1 a patient 11, shown in reclining position, is fitted with a chest cuff 10, abdominal cuff 12 and leg cuffs 14. A primary low-pressure-high-volume-compressor 16 supplies air to a volume chamber 16*a* (for smoothing out pressure fluctuations resulting from the periodic inflation of the cuffs). The volume chamber is connected to air handlers 18 (chest) and 20 (abdomen) via lines 16*b* and to air handlers 22 (legs) via line 16*c* and back flow valve 64, to be described. A suitable compressor may be obtained from the Parker Hannifin Corporation under part no. 737-23-01. An adjustable flow restrictor 16*d* connected between the compressor and the volume chamber (in line 16*e*) controls the flow rate to the volume chamber to say about 150 l/min. A pressure compensated relief valve (to be described) controls the volume chamber pressure, e.g., 2-3 psi. The individual air handlers are mounted in a common manifold block 23 to supply air, under the moderate volume chamber pressure, to the several cuffs through lines 10*a*, 12*a*, and 14*a* (via quick disconnect couplings 10*b*, 12*b* and 14*b*), as shown. A source of pneumatic control signals, such as a secondary air compressor 26, supplies a moderate control signal pressure, e.g. 15 psi., to a solenoid/pneumatic circuit 28 described in connection with FIG. 7. The circuit 28 responds to control signals routed through solenoid valves (hereinafter sometimes simply referred to as "solenoids"), under the control of a timer 24 (such as the solenoids and timer disclosed in FIG. 4B of the '278 pub.), to actuate the air handlers in accordance with the dictates of the timer. A ventilator 30 provides breathable gas, such as oxygen, to the patient 11 through a conventional face mask 30*a* and quick disconnect coupling 30*b*' in the manner disclosed in the '278 pub.

Figure 14A:
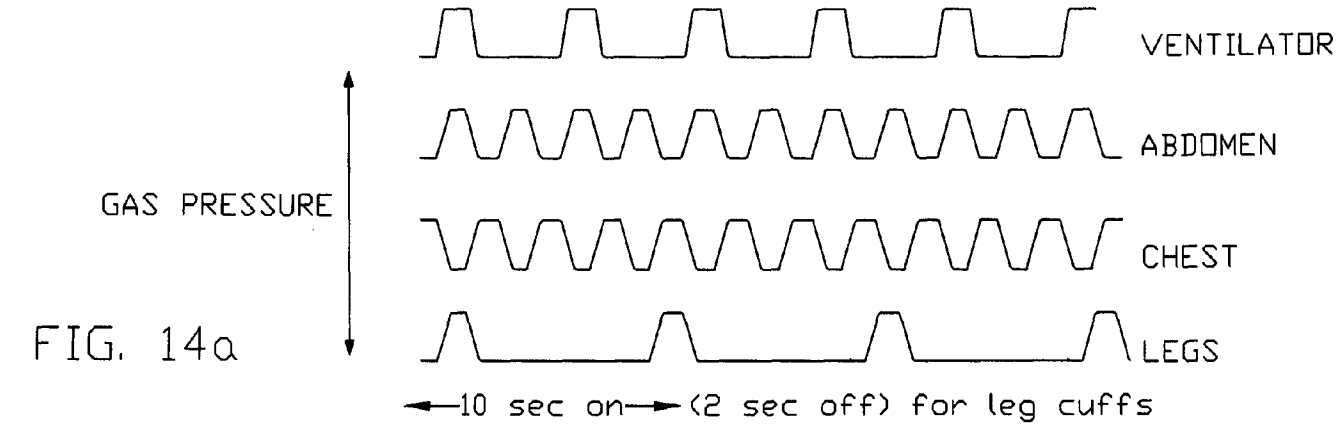
FIG. 14*a* is a graph illustrating the control of gas pressure to the ventilator and cuffs in an exemplary mode.
Figure 14B:
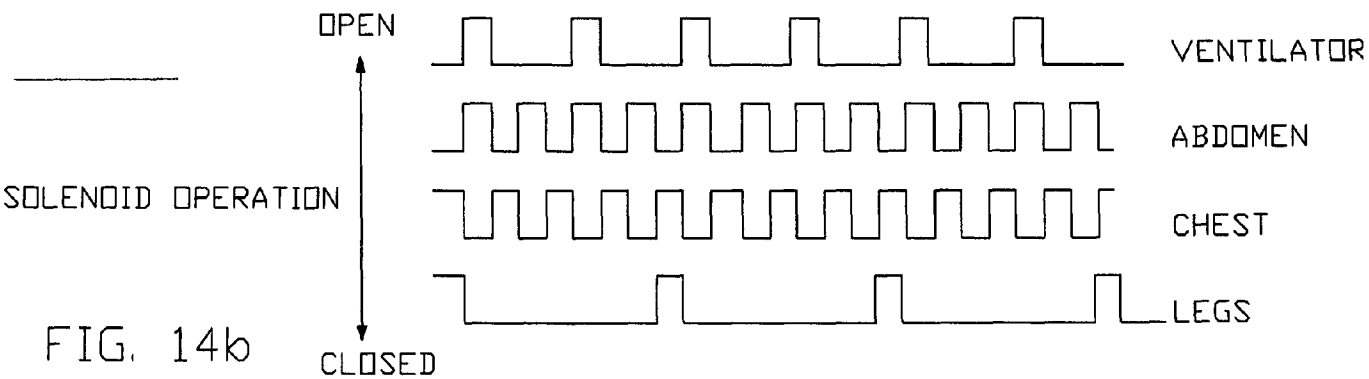
FIG. 14*b* illustrates operation of the solenoid valves to provide the gas pressure control illustrated in FIG. 14*a*.

In an automated exemplary mode, the chest and abdominal cuffs are continuously inflated and deflated in an out of phase relationship in one second intervals, that is, one second inflated and one seconded deflated, while the leg cuffs are inflated and deflated in 10 second and 2 second intervals, respectively. See FIG. 14 for a graphic depiction of this exemplary mode of operation. A cyclical rate/pressure switch (to be described) allows an operator, to set the rate and volume chamber pressure. For example, the rates may be set at 30 cycles/minute and the volume chamber pressure at 150 mmHg for resuscitation purposes and at 20 cycles/minute with the pressure at 100 mmHg for circulation support. The solenoid/pneumatic circuit 28 incorporates manually operated ball valves allowing an operator to override the timer and close the inflation diaphragm valves of the air handlers for all of the cuffs and, if desired, continuously apply a control signal to the leg cuffs' deflation diaphragm valve while isolating the control signal from the leg cuffs' inflation diaphragm valve, leaving the left cuffs continuously inflated.

Discussion of the Air Handlers

Figure 2:
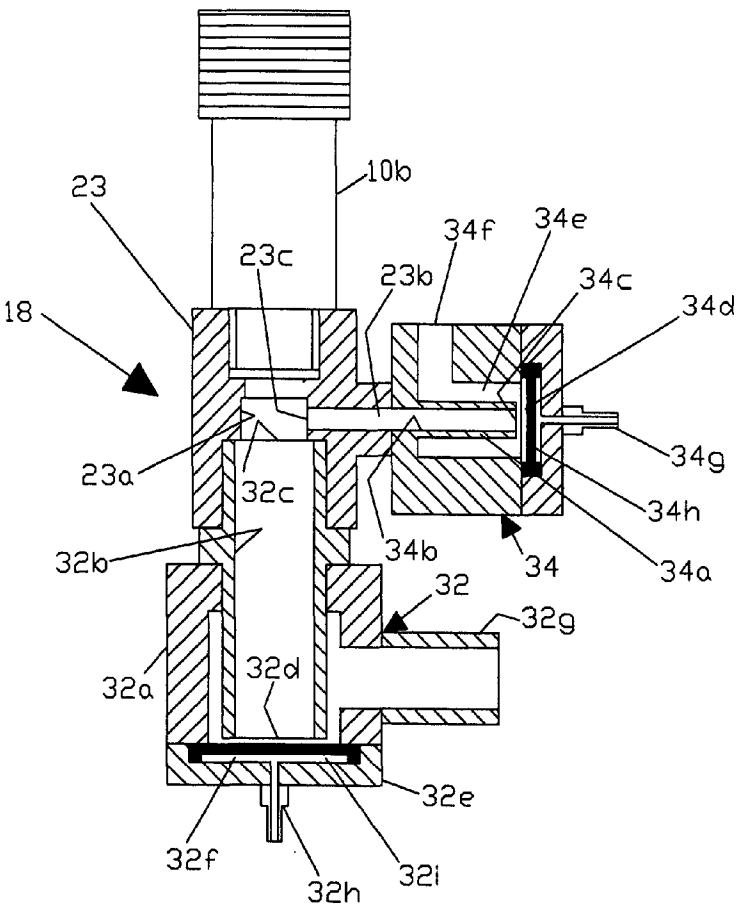
FIG. 2 is a cross sectional view of an air handler comprising an air module (forming the inflation diaphragm valve) and an air relay (forming the deflation diaphragm valve) mounted to a common manifold block with both valves open, allowing air flow to and from an associated cuff.
Figure 3:
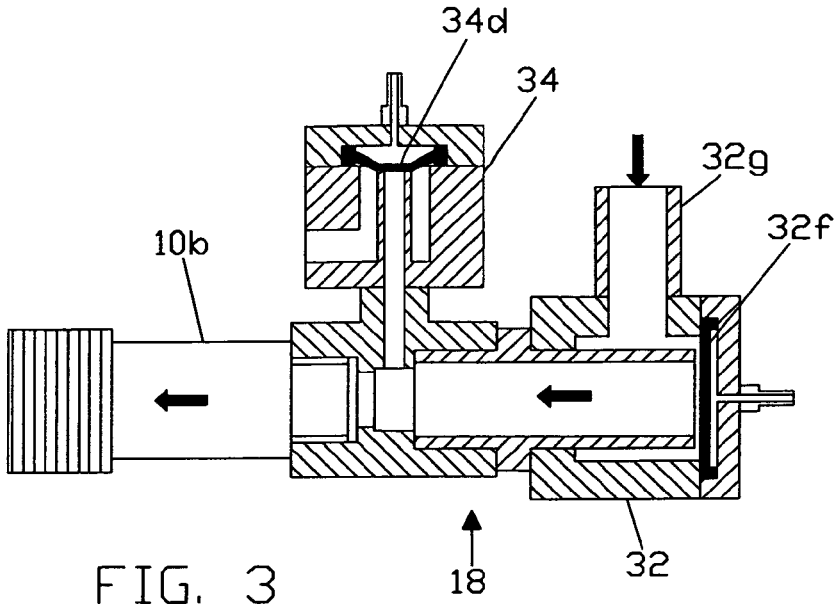
FIGS. 3 and 4 represent the same view as FIG. 2 showing the valves arranged to inflate and deflate the cuff, respectively.
Figure 4:
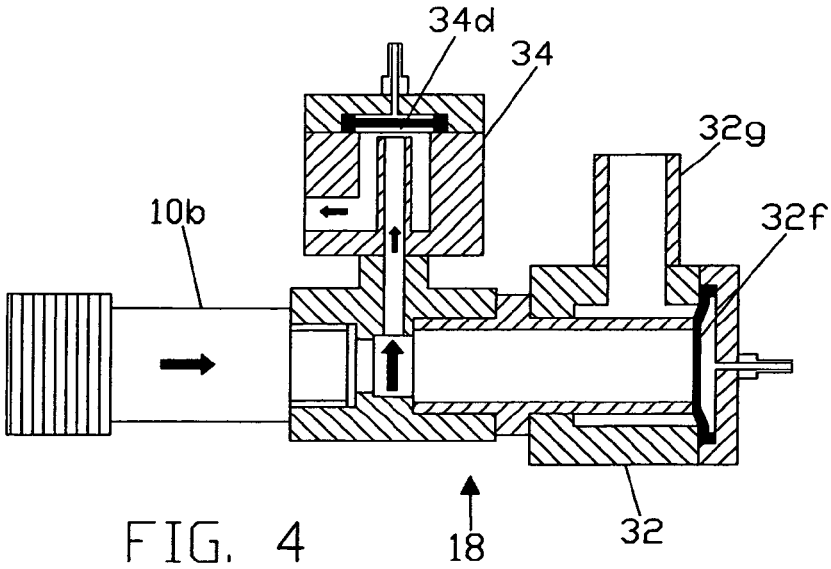
Figure 6B:
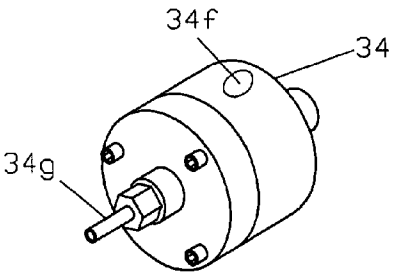
FIGS. 6*a* and 6*b* are front and perspective views of the air relay (deflation diaphragm valve), respectively.
Figure 5B:
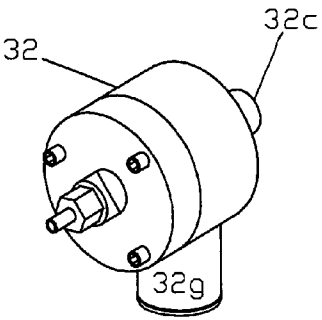
FIGS. 5*a* and 5*b* are bottom and perspective views of the air module (inflation diaphragm valve), respectively.
Figure 6A:
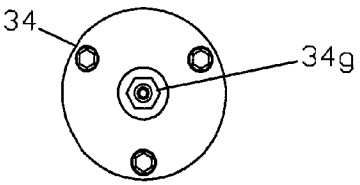
Figure 5A:
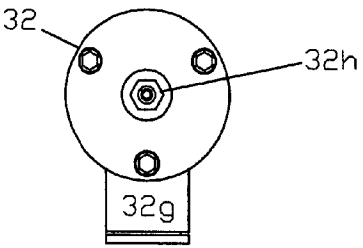

All of the air handlers are identical with the chest cuff air handler 18 which is shown in a cross sectional view in FIGS. 2-4. The air handler 18 comprises an air module 32, in the form of an inflation diaphragm valve, and an air relay 34, in the form of a deflation diaphragm valve, mounted on a common manifold block 23. The air modules for the abdomen and legs cuffs are identified by the reference numerals 36 and 40, respectively, in FIGS. 1 & 7, while the air relays for the abdomen and leg cuffs are identified by the reference numerals 38 and 42, respectively, in those figures.

Referring again to FIGS. 2-4, the air module 32, having an outer body 32*a* and an inner tubular member 32*b*, is secured within a bore 23*a* in the block 23. The tubular member 32*b* terminates at its distal end 32*c* within the longitudinal bore 23*a* of the block and at its proximal end 32*d* a short distance from the inner surface of an end cap 32*e*, as shown. The longitudinal bore 23*a* terminates in the quick disconnect coupling 10*b* for transferring air to and from the chest cuff. A flexible diaphragm 32*f*, mounted within the body 32*a*, is normally spaced from the proximal end 32*d* of the tubular member as is shown in FIG. 2. A tubular inlet 32*g* of the inflation diaphragm valve or air module is arranged to be connected to the volume chamber 16*a* via the hose connection 16*b* (FIG. 1). A control signal inlet nipple 32*h* is arranged to conduct pneumatic control signals, emanating from the secondary compressor, to a chamber 32*i*, to force the diaphragm 32*f* against the proximal end 32*d* of the member 32*b* and close the air module or inflation diaphragm valve, as will be discussed in more detail.

The air relay 34 (deflation diaphragm valve), mounted to the block 23 as shown, includes a tubular member 34*a* extending (at its distal or inlet end 34*b*) from a lateral bore 23*b* in the manifold block (which terminates at outlet 23*c* in the common longitudinal bore 23*a*) to a proximal end 34*c*. The proximal end is normally spaced a short distance from a flexible diaphragm 34*d* with an annular volume 34*e*, surrounding the tube 34*a*, which opens to the atmosphere or ambient via an outlet orifice 34*f* to exhaust the chest cuff when the diaphragm valve is open. A nipple 34*g* is arranged to conduct (pressurized) control signals to a chamber 34*h* which closes the deflation diaphragm valve.

The air handler 18 is shown in its normal state in FIG. 2 (with both diaphragm valves open in the absence of the application of control signals) so that air is free to flow between the cuff, the volume chamber and the atmosphere.

FIG. 3 shows the same air handler with the diaphragm valves of the air module and air relay open and closed, respectively, inflating the chest cuff. FIG. 4 shows the air handler with the diaphragm valves of the air module and the air relay closed and open, respectively deflating the cuff.

See FIGS. 5*a*, 5*b*, 6*a* and 6*b* for front and perspective views of the air modules and air relays, respectively.

Discussion of the Pneumatic/Solenoid Circuitry and Accessory Components

Figure 7:
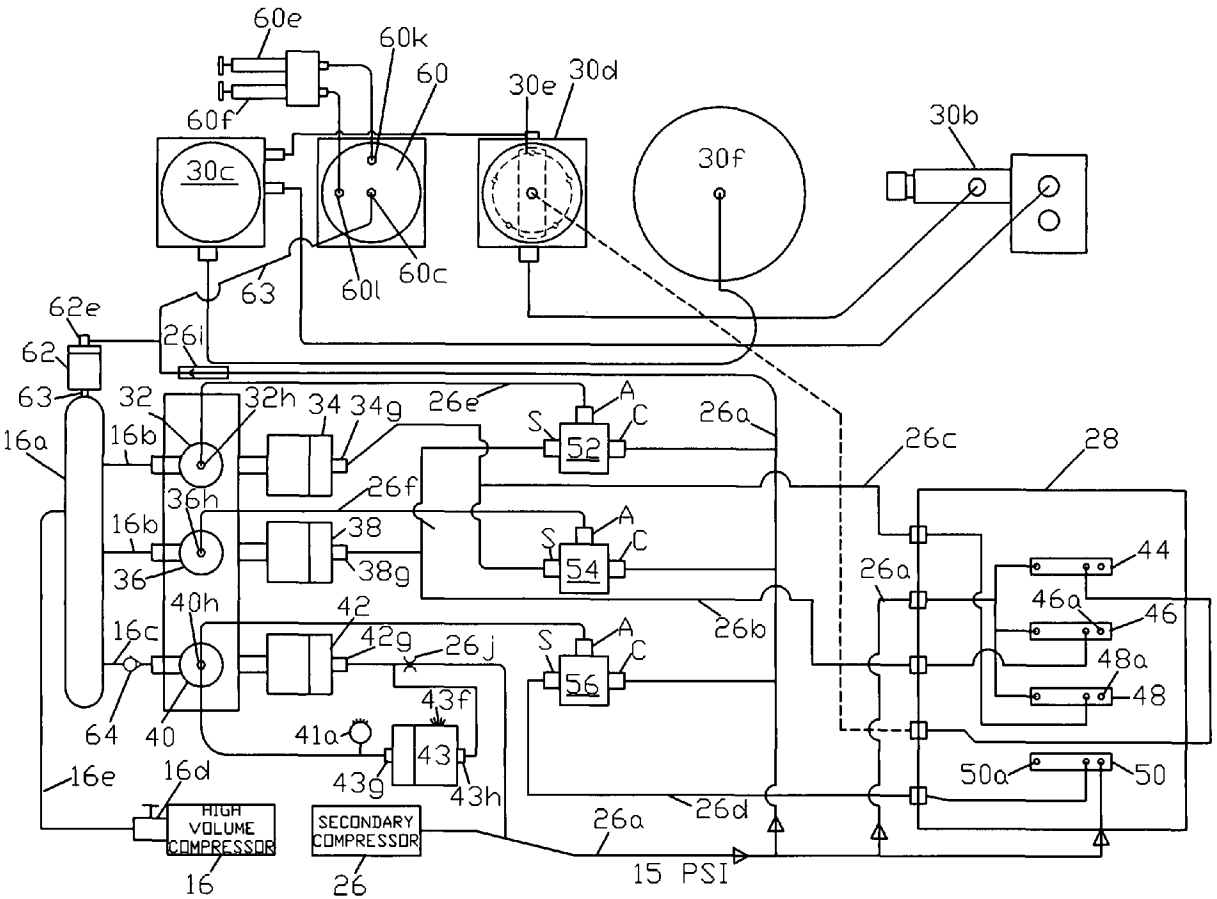
FIG. 7 is a pneumatic circuit diagram illustrating one method of operating the air handlers to inflate and deflate the several cuffs, i.e, with the chest and abdominal cuffs being inflated/deflated alternately.

Referring now to FIG. 7 which represents the pneumatic/solenoid circuit 28 and ventilator 30 depicted in FIG. 1. The ventilator, chest, abdomen and leg solenoids are given reference numerals 44, 46, 48 and 50 and correspond to solenoids 140-1, 140-2, 140-3 and 140-4 in FIG. 1A of the '278 pub., respectively. The secondary compressor 26 supplies a constant pressurized (say 15 psi) control signal on line 26*a*. The solenoid ports 46*a*, 48*a* and 50*a* are open to the atmosphere and serve the purpose of evacuating lines connected thereto by the solenoids.

The Pneutronics Division of Parker Hannifin Corporation offers such solenoids under the X-valve designation.

The pneumatic circuit includes manually adjustable ball valves 52, 54 and 56 with solenoid receptive ports S for accommodating automatic operation of the system in cooperation with air module interrelated ports A. Closure ports C provide closure of the air modules in cooperation with the control signal ports A, as will be explained. Ball valve 56 includes an additional function of allowing the continuous inflation of the leg cuffs by preventing control signals from reaching the air module 40. An exhaust diaphragm valve 43, when closed due to the absence of a control signal applied to nipple 43*g*, allows the control signal passing through the restrictor 26*j* to close the air relay 42 allowing the cuffs to inflate. Air bleed orifice 41*a* also plays a part in controlling the operation of exhaust valve 43 by exhausting the pressure present at nipple 43*g* when the associated control signal is absent.

As discussed above, in an exemplary mode, the chest and abdomen cuffs are inflated and deflated alternately. As a result, when the chest cuff solenoid 46 is actuated to connect the pneumatic line 26*b* to the pressurized line 26*a*, the abdomen solenoid 48 is inactivated disconnecting the line 26*c* from the control signal source, i.e. line 26*a*. The control signal applied to nipple 38*g* of air relay 38 closes off the abdomen cuff from the atmosphere while the abdomen cuff is connected to the volume chamber 16*a* as a result of the absence of a control signal being applied to the nipple 36*h* of the abdomen air module 36, thereby allowing the abdomen cuff to inflate. At the same time the control signal on line 26*b* is routed through ports S and A of the three-way valve 52 to the nipple 32*h* of the chest air module via line 26*e*. The presence of the control signal closes off the chest cuff from the volume chamber, while the air relay 34 is open due to the absence of a control being applied to nipple 34*g*, connecting the chest cuff to the atmosphere.

When the abdomen solenoid is activated the control signal is applied to the chest air relay 34 (via nipple 34*g*) and to abdomen air module 36 (via line 26*f* and nipple 36*h*) disconnecting the abdomen cuff from the volume chamber and the chest cuff from the atmosphere. The absence of a control signal being applied to the air relay 38 and the air module 32 results in inflating the chest cuff and deflating the abdomen cuff.

The ball valves 52 and 54 can be rotated to connect the A ports to the C ports for closing the chest and abdominal air modules by connecting line 26*a* to the nipples 32*h* and 36*h*, thereby overriding the operation of the respective solenoid valves. In response to the absence of the next control signal the air relays 34 and 38 will open to connect the associated cuffs to the atmosphere resulting in the deflation of the cuffs.

Since the leg cuff(s)' air handler operates independently, several accessories, namely exhaust valve 43, bleed orifice 41*a* and flow restrictor 26*j* are needed for its control. The exhaust valve 43 has its input nipple 43*g* connected in parallel with the input nipple to the leg cuff(s)' air module as shown. As a result when solenoid 50 is activated (as shown) a control signal is applied to the input nipples 40*h* and 43*g* of the air module 40 and exhaust valve 43, respectively, via ports S and A in the ball valve 56 to close the air module and open the exhaust valve. At the same time the control signal pressure at the input nipple 42*g* of air relay 42 is exhausted to the atmosphere through exhaust valve 43 allowing this relay to open. Restrictor 26*i* serves the function of allowing the exhaust valve, when open, to drop the pressure at the nipple 42*g* thereby removing the control signal to that relay and allowing it to open, deflating the cuffs The restrictor 26*i* aids in the accomplishment of this function by restricting the flow through line 26*a*.

When the solenoid 50 is inactivated (or open) the control signal disappears from the air module 40 and the exhaust valve 43. This action connects the air module to the volume chamber, closes the exhaust valve 43 and applies the control signal (say 15 psi), via restrictor 26*j*, to the air relay 42. This control signal closes the air relay 42 and disconnects the leg cuff(s) from the atmosphere, allowing the cuff(s) to inflate.

Figure 8B:
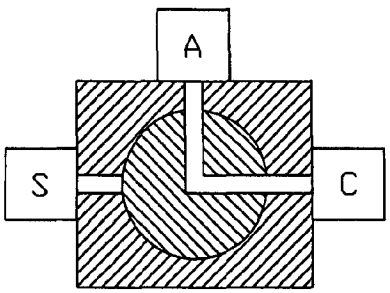
FIGS. 8*a*, 8*b* and 8*c* are cross sectional views of one of the ball valves of FIG. 7 showing possible valve positions to (1) allow the operation of the solenoids, in response to the timer, to control the inflation/deflation of the cuffs, (2) apply the control signal continuously to inflation diaphragm valve to close the same and (3) with respect to leg cuffs to isolate the inflation diaphragm valve from the control signals, respectively.
Figure 8C:
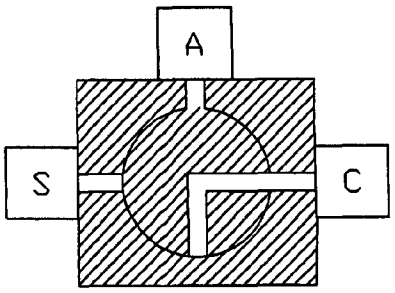
Figure 8A:
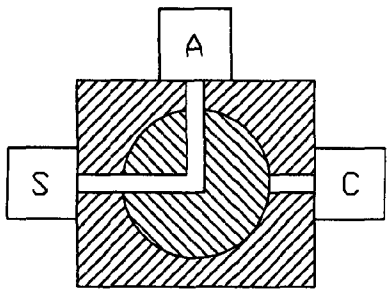

Cross-sectional views of the ball valves 52, 54 and 56 are shown in FIGS. 8*a*-8*c* with the ports S, A and C. FIG. 8*c*, illustrates the configuration of valve 56 in a position to disconnect the leg cuff(s)' air module 40 and the exhaust valve 43 from the source of control signals. This action allows the bleed orifice 41*a* to bleed off any residual pressure existing at the inlet nipples 40*h* and 43*g* (1) causing the air module to open connecting the cuff to the volume chamber and (2) closing the exhaust valve 43. At the same time the pressurized control signal flowing through restrictor 26*j* closes the air relay 42 disconnecting the cuff from the atmosphere. As a result the cuff(s) are continuously inflated as long as the valve 56 is set in this position as discussed above. Suitable ball valves may be acquired from the Hy-Lok Corporation under its 112 series designation.

Figure 9B:
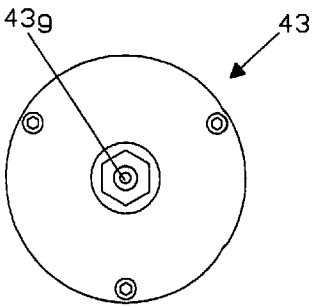
FIGS. 9*a* and 9*b* are a cross sectional and end view of an exhaust valve, respectively.
Figure 9A:
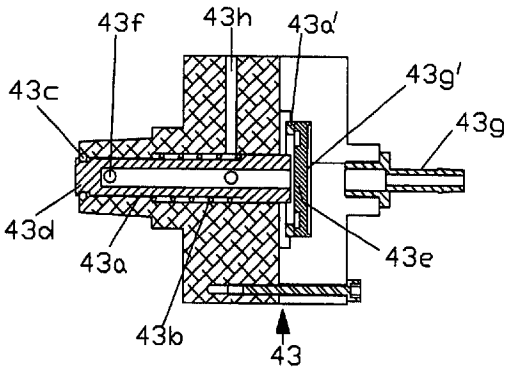

Referring now to FIGS. 9*a* and 9*b*, the exhaust valve 43 is in the form of a poppet valve having an inlet 43*f* (arranged to be connected to the nipple 42*g*, FIG. 7), an axially moveable shaft 43*a* biased into a closed position (via spring 43*b*) so that O ring 43*c* seats against valve seat 43*d*. Outlet 43*h* is open to the atmosphere. A flexible diaphragm 43*e* is spaced between the proximal end 43*a*' of the shaft 43*a* and a control signal receptive cavity 43*g*' in fluid communication with the control signal nipple 43*g*. Pressure of the control signal in the cavity 43*g*' forces the diaphragm against the proximal end of the shaft 43*a* and opens the valve connecting the inlet 43*f* to the outlet 43*h* i.e. the atmosphere.

Figure 10B:
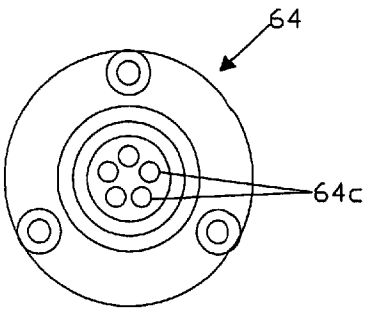
FIGS. 10*a* and 10*b* are a cross sectional and end view of a back flow valve, respectively.
Figure 10A:
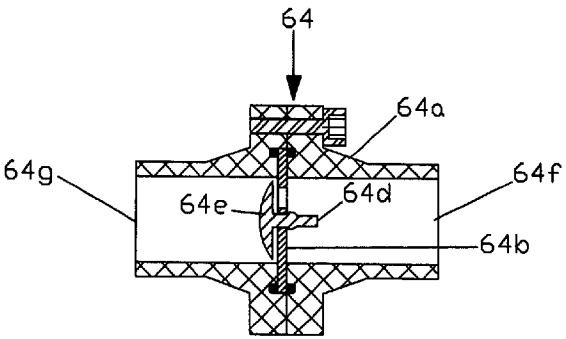
Figure 11C:
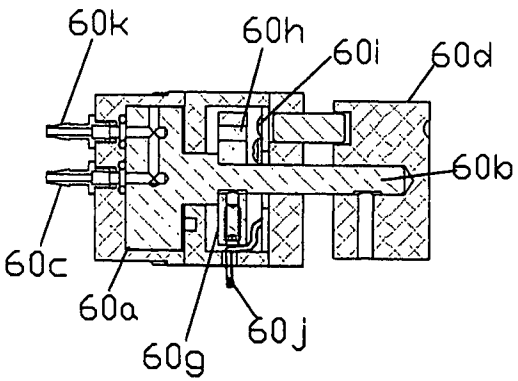
FIGS. 11*a*, 11*b* and 11*c* are perspective, front and cross sectional views of the selector valve of FIG. 7 for controlling the cyclical rate and cuff pressure.
Figure 11B:
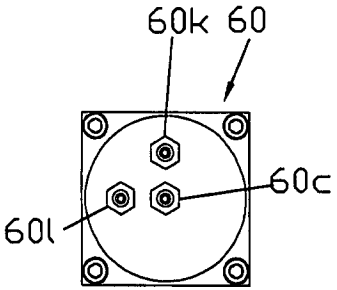
Figure 11A:
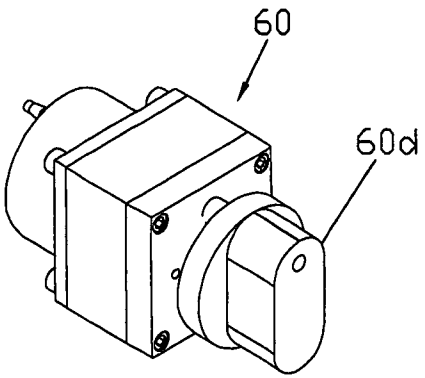
Figure 12A:
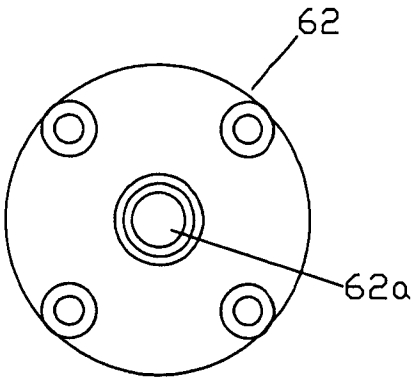
FIGS. 12*a* and 12*b* are an end view and a cross sectional view, respectively, of the pressure compensated discharge valve which controls the pressure in the volume chamber.
Figure 12B:
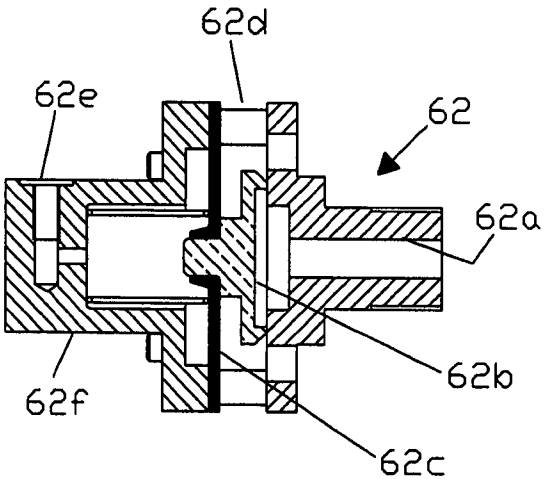

The backflow or check valve 64, illustrated in FIGS. 10*a* and 10*b*, includes a housing 64*a* in which are mounted a valve plate 64*b*, having a plurality of central openings 64*c*, and a valve stem 64*d* with a deformable head 64*e*. An inlet 64*f* is arranged to be connected to the volume chamber 16*a* while the outlet 64*g* is arranged to be connected to the inlet 32*g* of the air module 40 via line 16*c*. See FIGS. 1&7. The operation of such a simple backflow valve is simple and will be well understood by those skilled in the art. Its purpose is to isolate the leg cuff(s) from the volume chamber while the chest and abdominal cuffs are being inflated and thereby eliminate pressure fluctuations in the cuffs which might otherwise occur.

Discussion of the Selector Switch for Setting the Cyclical Rate and Volume Chamber Pressure Referring now to FIGS. 7, 11*a*-11*c* and 12*a*-12*b*, the rotary selector switch 60 performs two separate functions, namely providing one of two cyclical rates e.g. 30 cycles per minute ("cpm") or 20 cpm and one of two volume chamber (cuff) pressures e.g. 150 mm or 100 mm of Hg. The switch has a first rotor assembly 60*a* with a shaft 60*b* and a pneumatic inlet 60*c*. The shaft 60*b* when rotated, via manual actuated knob 60*d* (FIG. 11*a*), connects the inlet 60*c* to one of two relief valves 60*e* and 60*f* (FIG. 7), via pneumatic outlet nipples 60*k* and 60*l*, respectively. The relief valves may be set, for example, at 150 and 100 mmHg, respectively. The inlet 60*c* is connected to the dome 62*f* (via inlet 62*e*) of a compensated relief valve 62 (FIG. 12*b*) secured to the volume chamber 16*a* (FIG. 1) through an inlet 62*a* and a fitting 63 (FIG. 7). Referring again to FIG. 12*b*, the poppet 62*b* carries a diaphragm 62*c* positioned between the atmosphere (via outlet 62*d*) and the inlet 62*a*. The pressure in the volume chamber cannot exceed the pressure in line 63, as will be apparent to those skilled in the art.

Referring again to FIG. 11*c* the rotary switch 60 includes a second rotor assembly 60*g* carrying a magnet 60*h* which, when placed in close proximity to a Hall 1C sensor 60*i*, sends a digital signal, via output 60*j*, to the timer to change the cyclical rate as will be explained with respect to a modification of the timer shown in FIG. 13.

Discussion of the Modification of the '278 Pub. Timer

Figure 13:
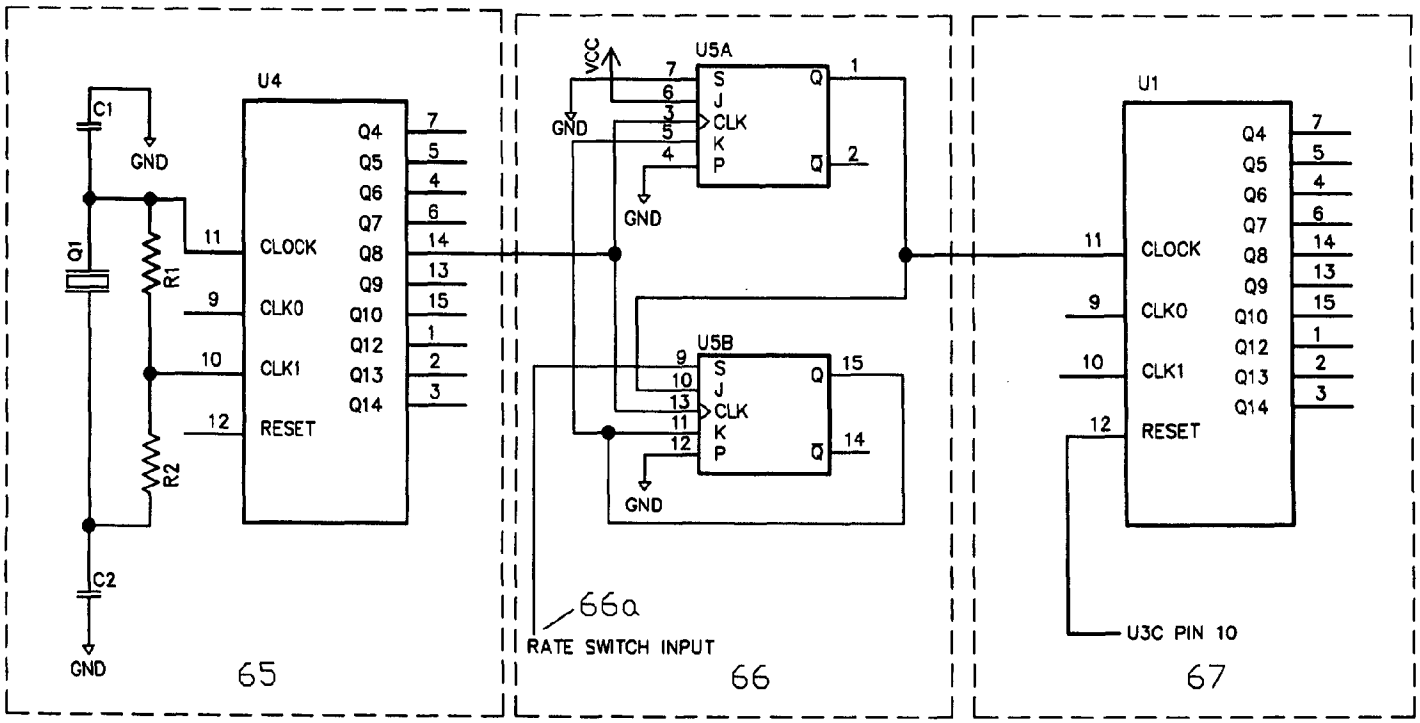
FIG. 13 is a electrical schematic circuit diagram of a modification of the circuit shown in FIG. 4B of the '278 pub. to accommodate two cyclical rates for inflation/deflation.

A modification of the timer disclosed in FIG. 4B of the '278 pub., necessary to respond to the digital signal from the rate selector 60 (FIG. 8*b*), is illustrated in FIG. 13. The time base 140-A (oscillator components C2, R18) of FIG. 4B ('278 pub.) is deleted and replaced by (1) a crystal oscillator/divide by 256 (reference No. 65 in FIG. 13, herein) and (2) a dual J-K divide by 2 or 3 (reference 66 in FIG. 13). The particular divider ratio activated is determined by the digital signal received on input 66*a* from the output on line 60*i* of the rate selector switch 60. The divider 67 comprises the oscillator/divider U1 from the '278 pub. Dividers U5A and U5B constitute the dual J-K dividers.

Discussion of the Ventilator Components

Referring again to FIG. 7, the ventilator is of the same type as described in the '278 pub. with a regulated oxygen supply 30*b* connected to a regulator 30*c* and a tidal volume control unit 30*d*. The output of the regulator 30*c* is connected to the mask 30*a* through the tidal volume control unit 30*d* and solenoid valve 44. The timer integrates the ventilation cycle with the abdomen compression cycles so as to operate without interruption. The ventilation cycle is timed to synchronize during abdominal compressions to prevent gastric insufflations and to deliver the correct tidal volume of oxygen during each compression of the abdomen. The tidal volume control unit includes a five position rotary switch (labeled 30*e*) within the control unit 30*d* which may be calibrated to deliver 400 ml, 600 ml, 800 ml and 1000 ml of breathable gas such as oxygen. A fifth position is the demand mode for use when the patient is breathing spontaneously. A gage 30*f* measures the pressure. In a preferred mode the oxygen is delivered for one second during every second cycle of the abdomen cuff inflation, followed by three seconds off.

CONCLUSION

There has been disclosed a simple and versatile system or apparatus for not only aiding a patient undergoing cardiac arrest to achieve the return of spontaneous circulation but to continue supporting the patient's circulation to improve his/her chances of long term survival after ROSC has been achieved. The diaphragm valves and air compressors are highly reliable and efficient, requiring little maintenance. It is to be noted that the various air pressures discussed above are by way of example only. Obviously the volume chamber pressure has to be adequate to properly inflate the cuffs; by the same token the control signal pressure must be sufficiently greater than the volume chamber pressure to insure closure of the diaphragm valves in the configuration as shown. While the apparatus is illustrated as operating in an automated mode with a higher cuff pressure and cyclical rate to achieve ROSC and with a lower pressure and cyclical rate subsequently, the invention is not so limited.

It is also to be noted that while the air modules and air relays are shown as being normally open and closed in response to the application of a control signal, one or both may be configured to be normally closed and opened in response to the control signal. As an example, the air relays may have a configuration similar to the exhaust valve 43 so that in the absence of a control signal the cuffs will be inflated and in response to a control signal the cuffs will be deflated. The system may be mounted on a wheeled cart for portability in a hospital or used in a paramedic's truck with compressors operating off of the truck's electrical system. While those skilled in the art may discover modifications or even improvements to the disclosed apparatus it is believed that such modifications will not involve a departure from the scope and spirit of our invention as defined in the appended claims.

What is claimed is:

1. A patient resuscitation system in which a plurality of inflatable cuffs are arranged to extend around separate portions of a patient's anatomy for enhancing the patient's blood flow when the cuffs are periodically inflated and deflated, wherein a timer sets the inflation and deflation period for each cuff, the improvement comprising:

a) a primary air compressor connected to a volume chamber for providing sufficient pressure therein to inflate the cuffs;

b) a pneumatic circuit including a secondary air source for providing separate pneumatic control signals for each cuff corresponding to the inflation and deflation periods set by the timer, the pneumatic control signals having a pressure greater than that present in the volume chamber; and c) an air handler individually connected between each cuff, the volume chamber and the atmosphere, each air handler being responsive to the pneumatic control signals and the absence of such control signals for placing the associated cuff(s) in fluid communication with the volume chamber or the atmosphere to inflate or deflate the associated cuff in accordance with the inflation and deflation periods set by the timer.

2. The resuscitation system of claim 1 wherein each air handler includes a normally open inflation diaphragm valve and a normally open deflation diaphragm valve with the inflation valve, located between each associated cuff and the volume chamber and the deflation valve located between the cuff and the atmosphere, the valves being arranged to close in response to the receipt of a pneumatic control signal and to remain open in response to the absence of said control signal.

3. The resuscitation system of claim 2 wherein the inflation diaphragm valve is in the form of an air module and the deflation diaphragm valve is in the form of an air relay, the air module and the air relay being individually responsive to the control signal or lack thereof, with the control signal being applied to only the air module or the air relay at any one time so that the application of the control signal to the air relay closes the deflation diaphragm valve which disconnects the cuff from the atmosphere and the absence of the control signal to the air module leaves the inflation diaphragm valve open inflating the cuff while the application of the control signal to the air module closes the inflation diaphragm valve and the absence of the control signal to the air relay opens the deflation diaphragm valve deflating the cuff as dictated by the timer.

4. The resuscitation system of claim 3 wherein the plurality of cuffs includes a chest cuff, an abdominal cuff and leg cuff(s), and wherein the pneumatic circuit includes a control valve for each of the cuffs, the control valves for the chest cuff and the abdominal cuff having an auto position in which the control signals are directed to the associated air modules and air relays to alternately inflate and deflate the chest cuff and the abdominal cuff, and an off position in which the associated air modules continuously receive control signals, the control valve for the leg cuffs having an auto position in which the leg cuffs are alternately inflated and deflated in accordance with the dictation of the timer, and an on position in which the leg cuffs are continuously inflated by continuously applying the control signal to the air relay while isolating the air modules from the control signal, and an off position in which the associated air module are continuously receives the control signals.

5. The resuscitation system of claim 1 further including a manually adjustable pressure and rate selector switch coupled to the volume chamber and the timer allowing the user to select two different cyclical rates of operation and two different pressures in the volume chamber wherein the timer is responsive to the cyclical rates selected by the pressure and rate selector switch to set the inflation and deflation periods accordingly.

6. The resuscitation system of claim 5 further including a source of breathable gas, a patient mask, and a manually adjustable tidal volume control unit with a multiple position selector switch responsive to the timer and connected between the breathable gas source and a patient mask, the selector switch allowing the user to determine the volume of breathable gas provided to the patient or accommodate the demands of the patient.

7. The resuscitation system of claim 1 wherein the source of pneumatic control signals is a secondary air compressor producing control signals having a pressure greater than the pressure in the volume chamber.

8. The resuscitation system of claim 3 wherein the timer is set to continuously inflate and deflate the chest and abdominal cuffs alternately, each cuff being inflated for one second and deflated for one second and wherein the timer is set to continuously inflate and deflate the leg(s) cuff with 10 seconds inflated and 2 seconds deflated.

9. The resuscitation system of claim 3 including a cyclical rate and pressure switch for setting the rate at which the timer sets the cyclical rate of inflation and deflation for the chest and abdominal cuffs and for setting the volume chamber pressure.

10. The resuscitation system of claim 9 wherein the cyclical rate is set at about 30 cycles per minute and the pressure is set at about 150 mm Hg.

11. The resuscitation system of claim 10 wherein the cyclical rate is set at about 30 cycles per minute and the pressure is set to about 100 mm of Hg.

12. A patient resuscitation system comprising:

a) an individual inflatable cuff adapted to extend around each of a patient's chest, abdomen and leg(s) for enhancing the blood flow in the patient's circulatory system when periodically inflated and deflated;

b) a timer for setting the inflation and deflation periods for each of the cuffs;

c) a solenoid individually associated with each cuff connected to the timer;

d) an air compressor connected to a volume chamber for providing sufficient pressure to inflate the cuffs when connected thereto;

e) a source of control signal pressure independent of the volume chamber;

f) a pneumatic circuit under the control of the solenoids and responsive to control signal pressure for providing separate pneumatic control signals for each cuff corresponding to the inflation and deflation period for that cuff; and g) an air handler individually connected between each cuff, the volume chamber and the atmosphere, each air handler being responsive to said pneumatic control signal and the lack of the pneumatic control signal for connecting the associated cuff to the volume chamber or the atmosphere to inflate and deflate the cuff in accordance with dictates of the timer, the volume chamber pressure constituting the cuff pressure when connected thereto.

13. The resuscitation system of claim 12 further including a cyclical rate and cuff inflation pressure switch arranged to set different cyclical rates and inflation pressure.

14. The resuscitation system of claim 13 wherein the pneumatic circuit includes manually operable valves allowing an operator to override the timer and maintain the cuffs in a deflated state.

15. The resuscitation system of claim 14 wherein one of the manually operable valves allows the operator to continuously inflate the leg cuff(s).

16. The resuscitation system of claim 12 wherein each air handler includes an air module connecting and disconnecting the associated cuff to the volume chamber in the absence and presence of the control signal, respectively, and an air relay connecting and disconnecting the associated cuff to the atmosphere in the absence and presence of said pneumatic control signal, respectively.

17. The resuscitation system of claim 16 further including an exhaust valve connecting and disconnecting the leg cuff(s) air relay to the pneumatic control signal in the absence and presence of said pneumatic control signal being applied to the leg cuff(s) air module, respectively.

18. The resuscitation system of claim 17 wherein the timer is arranged to cause (1) the chest and abdomen cuffs to inflate and deflate in an out of phase relationship at about one second intervals and (2) the leg cuffs to inflate and deflate for about 10 seconds and 2 seconds, respectively.

19. The resuscitation system of claim 13 further including a source of breathable gas, a face mask and a tidal volume control unit with a multiple position selector switch connected between the source of breathable gas and the mask allowing an operator to select the volume of gas supplied to the mask.

20. A system for the resuscitating patients undergoing cardiac or other serious heart ailments comprising:

a) at least one inflatable cuff adapted to extend around a portion of the patient's anatomy;

b) a timer for setting the time of inflation and deflation for the cuff;

c) a primary air compressor connected to a volume chamber;

d) a secondary air compressor for generating pneumatic control signals having a pressure greater than the pressure in the volume chamber;

e) an air handler connecting the cuff to the volume chamber or the atmosphere in response to the pneumatic control signals for inflating or deflating the cuff; and f) a pneumatic circuit under the control of the timer for channeling the control signals to the air handlers to inflate and deflate the cuff as dictated by the timer.

21. The system of claim 20 wherein said at least one cuff comprises a plurality of individual cuffs adapted to extend around separate portions of the patient's anatomy and wherein the system timer is arranged to set the inflation and deflation period for each of the cuffs and further including a separate air handler for each cuff.

22. The system of claim 20 wherein the system includes a cyclical rate and volume chamber pressure switch allowing an operator to set the chamber pressure to at least two different pressures and cyclical rates.

* * * * *